US011224252B2

(12) United States Patent
Lara, Jr.

(10) Patent No.: US 11,224,252 B2
(45) Date of Patent: Jan. 18, 2022

(54) PIPE

(71) Applicant: Santiago Lara, Jr., Fort Collins, CO (US)

(72) Inventor: Santiago Lara, Jr., Fort Collins, CO (US)

( * ) Notice: Subject to any disclaimer, the term of this patent is extended or adjusted under 35 U.S.C. 154(b) by 23 days.

(21) Appl. No.: 16/788,834

(22) Filed: Feb. 12, 2020

(65) Prior Publication Data

US 2020/0178597 A1 Jun. 11, 2020

Related U.S. Application Data

(63) Continuation of application No. 15/666,697, filed on Aug. 2, 2017, now Pat. No. 10,588,342.

(60) Provisional application No. 62/370,153, filed on Aug. 2, 2016.

(51) Int. Cl.
*A24F 1/16* (2006.01)

(52) U.S. Cl.
CPC ..... *A24F 1/16* (2013.01)

(58) Field of Classification Search
CPC ..... A24F 1/16; A24F 1/22; A24F 1/28
See application file for complete search history.

(56) References Cited

U.S. PATENT DOCUMENTS 924,508 A 6/1909 Talarico
973,870 A 10/1910 Matson
1,556,236 A 10/1925 Miller
1,671,908 A 5/1928 Schock et al.
1,939,473 A 12/1933 Torrese
1,994,036 A 3/1935 Fehring
2,003,156 A 5/1935 Robertson
2,146,256 A 2/1939 Gobel
2,248,259 A 7/1941 White
2,548,297 A 4/1951 Ferguson
3,037,512 A 6/1962 Aruar
3,282,271 A 11/1966 Ambruch
3,302,651 A * 2/1967 Baker ..... A24F 1/28 131/185
3,303,850 A 2/1967 Parrigin
3,354,888 A 11/1967 Parrigin
3,628,542 A 12/1971 Drew
3,774,624 A 11/1973 Fassbender
3,792,705 A 2/1974 Frederick
4,362,169 A 12/1982 Calkins
4,649,945 A 3/1987 Norman et al.
5,417,227 A 5/1995 West
6,418,936 B1 7/2002 Lee
7,350,523 B1 4/2008 Erickson
(Continued)

*Primary Examiner* — Eric Yaary
(74) *Attorney, Agent, or Firm* — Kilpatrick Townsend & Stockton LLP

(57) ABSTRACT

Various embodiments of a pipe for cooled smoke and containment are disclosed. In some embodiments, the pipe includes a body and a cover movable engaged to the body. The body includes a first end, a second end, and an axis extending between the first and second end. The body further includes a receptacle positioned closer to the first end than the second end. The cover includes an aperture. The aperture can be selectively aligned with the receptacle of the body. Optionally, the body includes one or more channels that direct smoke to travel along the axis of the body in opposite directions. Further optionally, the body includes one or more reservoirs that direct smoke to travel in a direction perpendicular to the axis.

17 Claims, 7 Drawing Sheets

(56) References Cited

U.S. PATENT DOCUMENTS

| | | | | |
|---|---|---|---|---|
| 2003/0221697 | A1 | 12/2003 | Erickson | |
| 2012/0060555 | A1 | 3/2012 | Parris | |
| 2014/0353856 | A1 | 12/2014 | Dubief | |
| 2014/0360513 | A1* | 12/2014 | Morgan | A24F 1/28<br>131/328 |
| 2015/0007833 | A1 | 1/2015 | Orvis et al. | |
| 2015/0157055 | A1 | 6/2015 | Lord | |
| 2015/0181929 | A1 | 7/2015 | Lisan et al. | |
| 2018/0035709 | A1 | 2/2018 | Lara, Jr. | |

* cited by examiner

PIPE

CROSS-REFERENCES TO RELATED APPLICATIONS

This application is a continuation of U.S. patent application Ser. No. 15/666,697, filed Aug. 2, 2017, which claims the benefit of and priority to U.S. Provisional Application No. 62/370,153, filed Aug. 2, 2016, which are incorporated herein by reference for all purposes.

BACKGROUND

This disclosure relates in general to devices that are designed for consuming smokeable materials and for processing smoke or vapor.

Various smoking devices exist for people to consume different types of smokeable materials. Usually, a user chooses a certain smoking device for its style/look and/or functionalities. For example, a user may use a water pipe to filter and cool the smoke. However, water pipes are generally cumbersome to carry around and the user has to be stationed at one place while using such a water pipe. On the other hand, a hand pipe offers portability but usually lacks the filtering and/or cooling functions. In addition, the construction of certain smoking devices involves many intricate parts, which not only involves complicated processes to manufacture but also a lot of efforts in caring for and maintaining such smoking devices. Therefore, there is room for improvement to the designs of existing smoking devices.

SUMMARY

Various embodiments of a pipe for cooled smoke and containment are disclosed. In one embodiment, a pipe for cooled smoke and containment includes a body and a cover movably engaged to the body. The body includes a first end and a second end. The second end is closer to a user than the first end during normal operation of the pipe. The cover includes a first aperture. The body includes a receptacle positioned closer to the first end than the second end. The body further includes a first channel and a second channel in fluid communication with the receptacle. The first channel is configured to allow smoke to travel away from the first end and toward the second end. The second channel is configured to allow smoke to travel away from the second end and toward the first end. The cover is configured to engage the body in a first position to allow the first aperture of the cover to align with the receptacle of the body. The cover is further configured to engage the body in a second position to interrupt air flow for the first channel and the second channel.

In another embodiment, a pipe for cooled smoke and containment includes a body. The body includes a first end, a second end, and an axis extending between the first end and the second end. The second end is closer to a user than the first end during normal operation of the pipe. The body includes a receptacle positioned closer to the first end than the second end. The body further includes a first reservoir positioned below a bottom of the receptacle. The first reservoir is configured to allow smoke to travel in a first direction perpendicular to the axis. The body further includes a first channel in fluid communication with the receptacle, and a second channel in fluid communication with the first channel. The first channel is configured to allow smoke to travel away from the first end and toward the second end. The second channel is configured to allow smoke to travel away from the second end and toward the first end.

In yet another embodiment, a pipe for cooled smoke and containment includes a body and a cover movably engaged to the body. The body includes a first end, a second end, and an axis extending between the first end and the second end. The second end is closer to a user than the first end during normal operation of the pipe. The body includes a receptacle positioned closer to the first end than the second end. The body further includes a first reservoir positioned below a bottom of the receptacle. The first reservoir is configured to allow smoke to travel in a first direction perpendicular to the axis. The cover further includes an aperture. The cover is configured to engage the body in a first position to allow the aperture of the cover to align with the receptacle of the body. The cover is further configured to engage the body in a second position to interrupt air flow into the receptacle through the aperture of the cover.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the appended figures.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

The ensuing description provides preferred exemplary embodiment(s) only, and is not intended to limit the scope, applicability or configuration of the disclosure. Rather, the ensuing description of the preferred exemplary embodiment (s) will provide those skilled in the art with an enabling description for implementing a preferred exemplary embodiment. It is understood that various changes may be made in the function and arrangement of elements without departing from the spirit and scope as set forth in the appended claims.

Figure 1A:
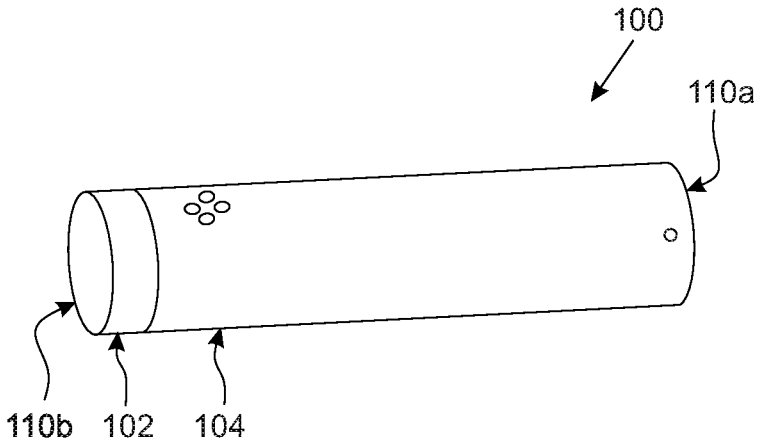
FIG. 1A illustrates a perspective view of an embodiment of a pipe.
Figure 1B:
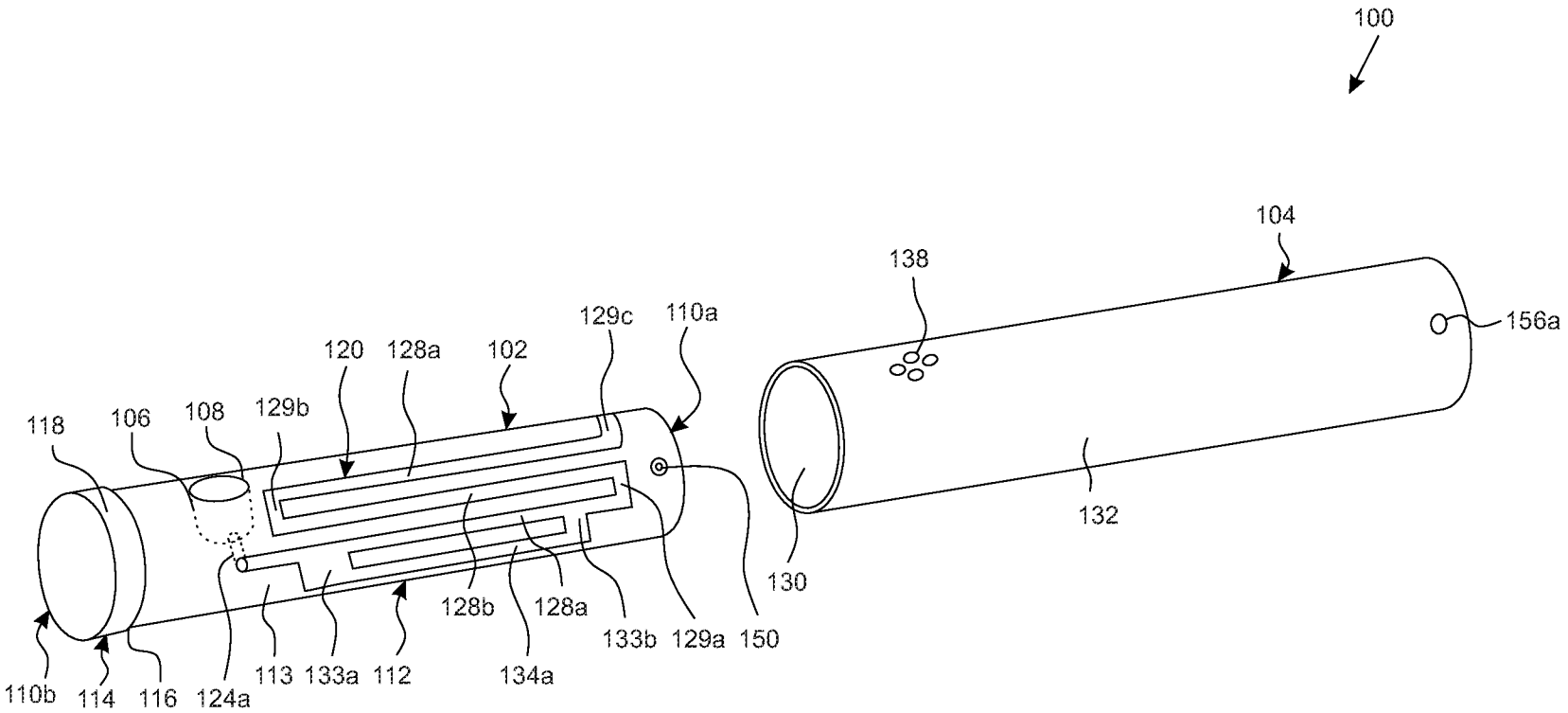
FIGS. 1B and 1C illustrate perspective views of the pipe of FIG. 1A, with the pipe disassembled.
Figure 1C:
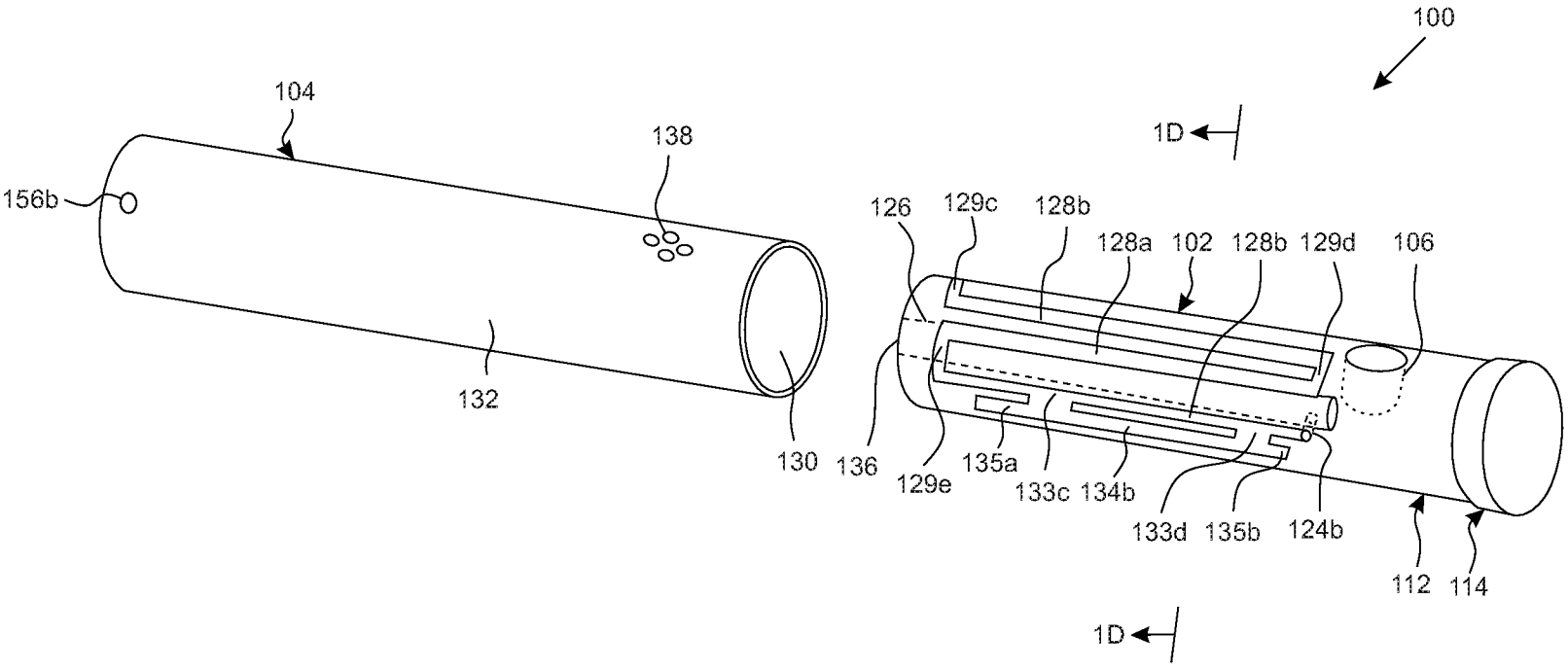

Referring to FIGS. 1A-1E, an embodiment of a pipe or smoking pipe 100 for processing smoke or product vapor is shown. This embodiment includes a body 102 that processes smoke or vapor and a cover or sleeve 104 that goes around the body 102. The body 102 further include a receptacle or bowl, more specifically, a smoking bowl 106 (FIGS. 1B and 1C). The bowl 106 is configured to receive, contain and/or store tobacco or any other materials or products suitable for smoking or consumption.

The pipe 100 can be disassembled (FIGS. 1B and 1C) such that the cover 104 is removed from the body 102. When assembled (FIG. 1A), the cover 104 and the body 102 define a smoke path 120 for the smoke or vapor to travel from the bowl 106 to a mouth end 110*a* of the body 102 or a mouthpiece attached to the mouth end 110*a*. During normal operation of the pipe 100, a user draws the smoke or product vapor from the mouth end 110*a* and/or the mouthpiece. The mouth end 110*a* is also referred to as the proximal end 110*a* with respect to the user, and the other end of the body 102 near which the bowl 106 is located is referred to as the bowl end 110*b* or the distal end with respect to the user. As will be discussed in more detail below, the pipe 100 is configured to cool the smoke or product vapor and to control the flow of the smoke or product vapor such that when the smoke or product vapor arrives at the mouth end 110*a*, the smoke or product vapor is cooled and any undesirable substances have been reduced or removed from the smoke or product vapor.

With further reference to FIGS. 1B and 1C, the body 102 includes a smoke processing portion 112 and a gripping portion 114 coupled or connected to the smoke processing portion 112. The gripping portion 114 and the smoke processing portion 112 are two coaxial bodies. The common axis of the smoke processing portion 112 and the gripping portion 114 defines a longitudinal axis of the body 102 extending from the bowl end 110*b* to the mouth end 110*a*. The smoke processing portion 112 is configured to cool the smoke and/or to remove undesirable substances or impurities from the smoke. The gripping portion 114 allows a user of the pipe 100 to hold the body 102 when placing the cover 104 around or removing the cover 104 from the body 102.

In this embodiment, the gripping portion 114 is formed or located near the bowl end 110*b* of the body 102. The exposed end of the gripping portion 114 defines the bowl end 110*b*, and the exposed end of the smoke processing portion 112 defines the mouth end 110*a*. In other embodiments, the gripping portion 114 may be formed or located near the mouth end 110*a* of the body 102. The exposed end of the gripping portion 114 defines the mouth end 110*a*, and the exposed end of the smoke processing portion 112 defines the bowl end 110*b*. In some embodiments, the body 102 may only include the smoke processing portion 112 and not include the gripping portion 114. One end of the smoke processing portion 112 defines the bowl end 110*b*, and the other end of the smoke processing portion 112 defines the mouth end 110*a*.

In some embodiments, the radius of the smoke processing portion 112 ranges from about 0.2 inches to about 0.8 inches. In some embodiments, the radius of the smoke processing portion 112 ranges from about 0.3 inches to about 0.6 inches. For example, the radius of the smoke processing portion 112 may be at least about 0.2, 0.3, 0.4, 0.5, 0.6, 0.7, or 0.8 inches in various embodiments. In some embodiments, the length of the smoke processing portion 112 ranges from about 2 inches to about 9 inches. In some embodiments, the length of the smoke processing portion 112 ranges from about 3 inches to about 8 inches. For example, the length of the smoke processing portion 112 may be at least about 2, 3, 4, 5, 6, 7, 8, or 9 inches in various embodiments.

In some embodiments, the radius of the gripping portion 114 ranges from about 0.3 inches to about 1.2 inches. In other embodiments, the radius of the gripping portion 114 ranges from about 0.6 inches to 1 inches. For example, the radius of the gripping portion 114 is at least about 0.2, 0.3, 0.4, 0.5, 0.6, 0.7, 0.8, 0.9, 1, or 1.2 inches in various embodiments. In some embodiments, the length of the gripping portion 114 ranges from about 0.2 inches to about 1.2 inches. In some embodiments, the length of the gripping portion 114 ranges from about 0.4 inches to 1 inch. For example, the length of the gripping portion 114 may be at least about 0.2, 0.4, 0.6, 0.8, 1.0, or 1.2 inches in various embodiments.

In some embodiments, the radius of the gripping portion 114 is greater than the radius of the smoke processing portion 112 by at least about 0.03 inches to 0.06 inches. For example, the radius of the gripping portion 114 is greater than the radius of the smoke processing portion 112 by at least about 0.02, 0.03, 0.04, 0.05, 0.06, or 0.07 inches in various embodiments. Accordingly, a step 116 is formed between the smoke processing portion 112 and the gripping portion 114. The step 116 limits lateral movements of the cover 104 relative to the smoke processing portion 112 and facilitates alignment between one or more apertures or air inlets 138 of the cover 104 (to be discussed in more detail below) and the bowl 106 of the body 102. In some embodiments, the difference between the radius of the gripping portion 114 and the radius of the smoke processing portion 112 corresponds to the thickness of the cover 104. As such, when the pipe 100 is assembled, the cover 104 and the gripping portion 114 form a smooth or continuous joint.

In this embodiment, the smoke processing portion 112 and the gripping portion 114 are each cylindrically shaped and have a circular cross section. In other embodiments, the smoke processing portion 112 and/or the gripping portion 114 may include one or more flat side surfaces. The pipe 100 can rest on the flat side surface such that the bowl 106 is maintained in a generally upright position to prevent spillage of the smokeable materials. In further embodiments, the smoke processing portion 112 and/or the gripping portion 114 may be shaped like a prism or other polyhedrons. The smoke processing portion 112 and/or the gripping portion 114 may have an oval, triangular, square, rectangular, diamond, pentagonal, hexagonal, or any other suitably shaped cross sections. The smoke processing portion 112 and/or the gripping portion 114 may have the same, similar, or different cross sectional shapes. In some embodiments, the smoke processing portion 112 may be shaped like a cylinder while the gripping portion 114 may include one or more flat side surfaces, or vice versa.

The smoke processing portion 112 and the gripping portion 114 are formed as a unitary body in this embodiment, but can be formed as two separate pieces connected or joined together in other embodiments. In some embodiments, the gripping portion 114 is connected to an end of the smoke processing portion 112 along the longitudinal extension of the smoke processing portion 112. In other embodiments, the gripping portion 114 may be shaped like a ring, a hollow tube, or a sleeve that can be placed around an end portion of the smoke processing portion 112.

Whether the gripping portion 114 is formed as a unitary body with the smoke processing portion 112 or is formed as a separate piece from the smoke processing portion 112, the gripping portion 114 and the smoke processing portion 112 can be made using the same or different materials. The smoke processing portion 112 can be made of metal, alloy, wood, glass, plastic, composite, or any other suitable materials. The gripping portion 114 can be made of metal, alloy, wood, glass, rubber, plastic, composite, leather, textile, or any other suitable materials. In some embodiments, the side surface 118 of the gripping portion 114 is formed with surface textures to provide additional friction for a user to hold the body 102 when placing the cover 104 around or removing the cover 104 from the body 102. In the case of metal or alloy, the smoke processing portion 112 and/or the gripping portion 114 can be made of aluminum, copper, iron, silver, brass, bronze, stainless steel, or any other suitable metals or alloys that can absorb heat from the smoke.

With further reference to FIGS. 1B and 1C, the bowl 106 is formed as a radial recess and positioned near the bowl end 110*b* of the body 102. The bowl 106 receives and/or stores tobacco or any other smokeable materials or products suitable for smoking or consumption. During normal operation of the pipe 100, the smokeable material is lit or heated (depending on the type of the smokeable material) inside the bowl 106, and smoke or product vapor is generated and travels from the bowl 106 to the mouth end 110*a* via the smoke path 120. In some embodiments, the bottom of the bowl 106 may be lined with a metal mesh layer, which helps to prevent the burned tobacco or other products from entering into the smoke path 120. In this embodiment, the bowl 106 is integrated into the body 102. Integrating the bowl 106 into the body 102 simplifies the manufacturing process and reduces costs. The integrated design also offers an elegant and sleek look that has great appeal. In other embodiments, the bowl 106 may be configured to engage an external or detachable bowl that receives smokeable material and allows the same to be burnt or heated therein. The engagement between the bowl 106 and the detachable bowl may be achieved by friction fit or mating threads.

The depth of the bowl 106 is similar to the radius of the smoke processing portion 112 in this embodiment, but the depth of the bowl 106 can be greater than the radius of the smoke processing portion 112 in other embodiments. For example, the depth dimension of the bowl 106 may be at least about 1.2, 1.4, 1.6, or 1.8 times the radius of the smoke processing portion 112 in various embodiments. In some embodiments, the bowl 106 may be formed as a through hole and the bottom of the bowl 106 is closed off by the cover 104 during normal operation of the pipe 100. In other embodiments, the bowl 106 may have a depth dimension that is less than the radius of the smoke processing portion 112. For example, the depth dimension of the bowl 106 may be no more than about 1, 0.9, 0.8, 0.7, 0.6, 0.5 times the radius of the smoke processing portion 112 in various embodiments.

The cross dimension of a bowl opening 108 (e.g., the diameter of the circular bowl opening 108 shown in FIGS. 1B and 1C) is similar to the depth of the bowl 106 in this embodiment, but the cross dimension of the bowl opening 108 can be greater than the depth of the bowl 106 in other embodiments. For example, the cross dimension of the bowl opening 108 may be at least about 1.2, 1.4, 1.6, 1.8, or 2 times the depth of the bowl 106 in various embodiments. In other embodiments, the cross dimension of the bowl opening 108 may be less than the depth of the bowl 106. For example, the cross dimension of the bowl opening 108 may be no more than about 1, 0.9, 0.8, 0.7, 0.6, 0.5, 0.4, 0.3, or 0.2 times the depth of bowl 106 in various embodiments.

The bowl opening 108 is circular in this embodiment, but the bowl opening 108 may be triangular, square, rectangular, diamond, pentagonal, hexagonal, semicircular, or of any suitable shape. In this embodiment, the bowl 106 extends along the radius of the smoke processing portion 112 and perpendicular to the axis of the body 102. In other embodiments, the bowl 106 may extend at an angle other than 90 degrees with respect to the axis of the body 102.

With further reference to FIG. 1B, the bowl 106 is communicatively coupled or connected with the smoke path 120 via a conduit or orifice 124*a*. The orifice 124*a* has one opening positioned near the bottom of the bowl 106 and the other opening positioned at an exterior surface 113 of the smoke processing portion 112. The smoke processing portion 112 includes one or more external or exterior channels 128 formed at the exterior surface 113. The external channels 128 and the cover 104 together form a portion of the smoke path 120 (to be described below). The smoke processing portion 112 further includes an internal or interior channel 126 that is communicatively coupled or connected with the external channels 128 via a conduit or orifice 124*b*. The internal channel 126, the external channels 128, the orifices 124*a*, 124*b*, and the cover 104 together form the smoke path 120 that allows and/or directs the smoke to flow from the bowl 106 to the mouth end 110*a*.

As shown in FIGS. 1B and 1C, the external channels 128 are formed as continuous grooves at the exterior surface 113 of the smoke processing portion 112. The grooves are about 0.187 inches deep and about 0.187 inches wide in this embodiment, but can be about 0.15 to about 0.25 inches deep and/or about 0.15 to about 0.25 inches wide in other embodiments. For example, the grooves may be at least about 0.1, 0.15, 0.2, 0.25, or 0.3 inches deep and/or at least about 0.1, 0.15, 0.2, 0.25, or 0.3 inches wide in various embodiments.

In this embodiment, the grooves of the external channels 128 are formed with substantially similar or consistent width and depth dimensions. In other embodiments, the external channels 128 may be formed with varying width and/or depth dimensions. The grooves may be further configured with undulating bottom and/or side surfaces that increase the contact area with the smoke to facilitate the cooling of the smoke. When the cover 104 is placed around the body 102, an interior surface 130 of the cover 104 contacts the exterior surface 113 of the smoke processing portion 112. The interior surface 130 of the cover 104 and the external channels 128 together form a portion of the smoke path 120 that directs the flow of the smoke along the external channels 128.

The external channels 128 include one or more first external channels 128*a* and one or more second external channels 128*b* that extend substantially parallel to the longitudinal axis of the body 102. The first external channels 128*a* and the second external channels 128*b* direct or allow the smoke to travel in opposite directions. The first external channels 128*a* allow the smoke to travel away from the blow 106 or the bowl end 110*b* towards the mouth end 110*a*. The second external channels 128*b* allow the smoke to travel away from the mouth end 110*a* towards the bowl end 110*b*.

In this embodiment, the first and second external channels 128*a*, 128*b* are generally parallel to each other and are connected by segments of channel portions or bends 129*a*, 129*b*, 129*c*, 129*d*, 129*e*. In other embodiment, the first and second external channels 128*a*, 128*b* may be formed at an angle with respect to each other and not parallel to each other. For example, the first and second external channels 128*a*, 128*b* may be formed in a generally zig-zag fashion.

In this embodiment, the first and second external channels 128*a*, 128*b* travel a portion of the length of the smoke processing portion 112 in a generally straight or linear fashion. In other embodiments, the first and second external channels 128*a*, 128*b* may traverse a portion of the length of the smoke processing portion 112 along a non-linear, such as curved or wavy path.

There are three first external channels 128*a* and three second external channels 128*b* in this embodiment, but more or less first and/or second external channels 128*a*, 128*b* may be implemented. The number of the first external channels 128*a* may be the same as or different from the number of the second external channels 128*b*.

Two longitudinal reservoirs 134*a*, 134*b* are formed along the external channels 128 for collecting and/or trapping condensations and/or precipitates, such as oil, moisture, burned tobacco, and/or other debris from the smoke. A first longitudinal reservoir 134*a* is formed near the beginning of the external channels 128 and a second longitudinal reservoir 134*b* is formed near the end of the external channels 128. Specifically, the first longitudinal reservoir 134*a* is formed as a segment of groove parallel to the first external channel 128*a* that is closest to the bowl 106 along the smoke path 120. The second longitudinal reservoir 134*b* is formed as a segment of groove parallel to the second external channel 128*b* that is closest to the internal channel 126 along the smoke path 120.

The first and second longitudinal reservoirs 134*a*, 134*b* are each positioned closer to the bottom of the smoke processing portion 112 than the first and second external channels 128*a*. As such, as the smoke travels through the first and second external channels 128*a*, 128*b*, condensations and/or precipitates are accumulated in the first and second longitudinal reservoirs 134*a*, 134*b* while the smoke path 120 is kept relatively clean.

The first longitudinal reservoir 134*a* is connected to the neighboring first external channel 128*a* via first and second connecting channels 133*a*, 133*b* at the ends of the first longitudinal reservoir 134*a*. After the smoke exits the bowl 106 and enters into the first external channel 128*a*, the smoke bifurcates at the first connecting channel 133*a* and travels along the first longitudinal reservoir 134*a* and the first external channel 128*a*. The smoke then converges at the second connecting channel 133*b*.

The first connecting channel 133*a* is wider than the second connecting channel 133*b*. Such arrangement facilitates the entering of condensations and/or debris into the first longitudinal reservoir 134*a* via the first connecting channel 133*a* while limiting or preventing the accumulated condensations and/or debris from existing the first longitudinal reservoir 134*a* via the second connecting channel 133*b*.

The second longitudinal reservoir 134*b* is connected to the neighboring second external channel 128*b* via third and fourth connecting channels 133*c*, 133*d*. The third and fourth connecting channels 133*c*, 133*d* are positioned near but not at the ends of the second longitudinal reservoir 134*b*. As such, two end pockets 135*a* and 135*b* are formed within which debris and/or condensations may be accumulated. As the smoke travels towards the second longitudinal reservoir 134*b*, the smoke bifurcates at the third connecting channel 133*c* and travels along the portion of the second longitudinal reservoir 134*b* between the end pockets 135*a*, 135*b* and along the second external channel 128*b*. The smoke then converges at the fourth connecting channel 133*d* and then enters into the internal channel 126 via the orifice 124*b*.

Similar to the arrangement of the first and second connecting channels 133*a*, 133*d*, the third connecting channel 133*c* is wider than the fourth connecting channel 133*d* to facilitate the entering of condensations and/or debris into the second longitudinal reservoir 134*b* via the third connecting channel 133*c* while limiting or preventing the accumulated condensations and/or debris from existing the second longitudinal reservoir 134*b* via the fourth connecting channel 133*d*.

Although only the second longitudinal reservoir 134*b* includes end pockets 135*a*, 135*b* in this embodiment, the first longitudinal reservoir 134*a* may also include end pockets 135 in other embodiments. In some embodiments, the first and/or second longitudinal reservoir 134*a*, 134*b* may include only one or no end pocket 135. The only one end pocket 135 may be positioned either trailing the smoke (such as the end pocket 135*a*) or leading the smoke (such as the end pocket 135*b*). The second and fourth connecting channels 133*b*, 133*d* may each be formed with a width dimension that is the same as or greater than the width dimensions of the first and third connecting channels 133*a*, 133*c*, respectively.

Figure 1D:
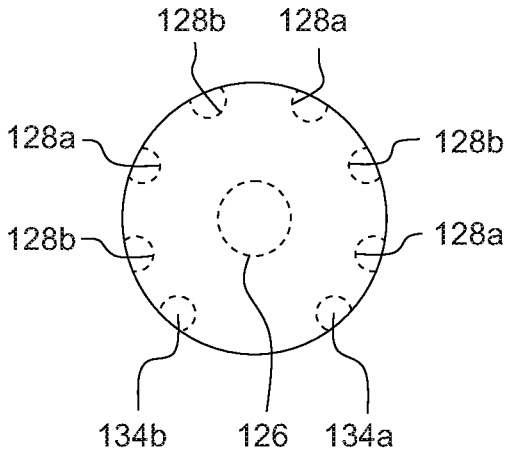
FIG. 1D illustrates a cross-sectional view of an embodiment of a body of the pipe of FIGS. 1A to 1C, viewed along line 1D-1D of FIG. 1C.

As shown in FIGS. 1B, 1C, and 1D, the external channels 128 and the longitudinal reservoirs 134 are generally formed at the side, top, and/or near the bottom of the exterior surface 113 of the smoke processing portion 112. Less or no external channels 128 and/or the longitudinal reservoirs 134 are formed at the bottom of the exterior surface 113. Such configuration allows more weight to be distributed near the bottom of the body 102. Such weight distribution helps to maintain the bowl 106 in an upright orientation when the pipe 100 is placed or rests on a surface.

Other arrangement of the exterior and internal channels 128, 126 may be contemplated to move the center of the mass of the body 102 towards the bottom of the body 102. For example, the internal channel 126 may be placed above the axis of the longitudinal axis of the body 102. The smoke processing portion 112 may include external channels 128 formed at the bottom of its exterior surface 113, with the external channels 128 formed at and/or near the top of the exterior surface 113 being wider and/or deeper than the external channels 128 formed near and/or at the bottom of the exterior surface 113.

Figure 1E:
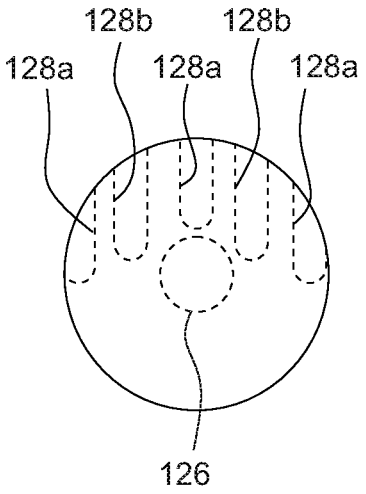
FIG. 1E illustrates a cross-sectional view of another embodiment of the body of the pipe.

In this embodiment, the exterior channels 128 include depth dimensions that extend towards the center or longitudinal axis of the body 102. The depth dimensions of the exterior channels 128 may extend generally parallel to each other and towards the lower portion of the body 102 as shown in FIG. 1E. The substantial vertical or upright arrangement of the exterior channels 128 increases the contact surface area between the smoke and the exterior channels 128, which facilitates the heat absorption by the smoke processing portion 112. The increased depth dimensions of the exterior channels 128 also allow an increased amount of condensations and/or debris to be accumulated before a cleaning is required, and the longitudinal reservoirs 134 becomes optional. Such arrangement of the exterior channels 128 further helps to maintain the bowl 106 in an upright position.

With further reference to FIG. 1C, once the smoke enters the internal channel 126 from the external channels 128 through the orifice 124*b*, the internal channel 126 directs the smoke to travel away from the bowl end 110*b* and towards the mouth end 110*a* until it reaches an outlet or opening 136 at the mouth end 110*a*. In this embodiment, the internal channel 126 is arranged along the longitudinal axis of the body 102. In other embodiments, the internal channel 126 can be arranged above, below, parallel to, or across the longitudinal axis of the body 102.

The internal channel 126 is formed as a hollow cylinder in this embodiment. The internal channel 126 has a diameter of about 0.3 inches in this embodiment, but may have a diameter of at least about 0.1, 0.15, 0.2, 0.25, 0.3, 0.35, or 0.4 inches in other embodiments. In some embodiments, the internal channel 126 can have semicircular, triangular, square, rectangular, diamond, pentagonal, hexagonal, or any other suitably shaped cross sections and may be configured with any suitable cross dimensions. The diameter of the internal channel 126 is consistent along the length of the internal channel 126 in this embodiment. The internal channel 126 may have a varying diameter or width dimension (e.g., a taper) along its length in other embodiments. In some embodiments, the internal channel 126 may further include a stepped or tapered profile near the mouth end 110*a*. For example, the internal channel 126 may include a greater cross dimension near the mouth end 110*a* for receiving a detachable mouth piece.

The internal channel 126 travels substantially the entire distance between the bowl 106 and the mouth end 110*a* in this embodiment, but may travel no more than about 90%, 80%, 70%, 60%, or 50% of the distance between the bowl 106 and the mouth end 110*a* in other embodiments. Similarly, the external channels 128 travel substantially the entire distance between the bowl 106 and the mouth end 110*a* in this embodiment, but may travel no more than about 90%, 80%, 70%, 60%, or 50% of the distance between the bowl 106 and the mouth end 110*a* in various embodiments.

Depending on the configuration of the internal and external channels 126, 128, the smoke path 120 may be at least 2, 3, 4, 5, 6, 7, 8, 9, or 10 times the distance between the bowl 106 and the mouth end 110*a*. With the increased travel distance, the heat of the smoke is absorbed by the body 102 and/or dissipate through the cover 104 as the smoke travels along the smoke path 120. The user enjoys a much cooler smoke and thus a more pleasant smoking experience. In addition, because a substantial portion of the smoke path 120 is formed by the external channels 128 on the exterior surface 113 of the smoke processing portion 112, it is easy to remove or clean any residues or deposits that may be formed along the smoke path 120.

During normal operation of the pipe 100, atmospheric pressure at sea level is applying a pressure of 14.7 PSI (the atmospheric pressure may vary depending on the location where the pipe 100 is operated) at the bowl opening 108. As the user creates a vacuum or reduced pressure at the opening 136 at the mouth end 110*a*, the smoke or product vapor is pulled from the bowl 106 into the external channels 128 through the orifice 124*a*, and then into the internal channel 126 through the orifice 124*b*.

The exterior channels 128 may emulate a "capillary tube." The smoke travels along the external channels 128 circuitously, i.e., from the bowl 106 or the bowl end 110*b* towards the mouth end 110*a* along the first external channels 128*a* for one or more times, and from the mouth end 110*a* towards the bowl end 110*b* along the second external channels 128*b* for one or more times. As the smoke travels through the external channels 128, the smoke processing portion 112 cools the smoke by absorbing the heat from the smoke. Condensations formed during this cooling process, as well as other precipitates and/or debris, are accumulated in longitudinal reservoirs 134.

As the smoke or product vapor travels through the conduit or orifice 124*b* to the vacuum created in the internal channel 126, the smoke pressure is decreased, allowing the heat energy in the smoke or product vapor to further conduct to the surface area in the internal channel 126. Because heat energy transfers from the hot smoke to the cold medium of the internal channel 126, the temperature of the smoke or product vapor is lowered. The circuitous smoke path 120 of the pipe 100 helps with the conservation of water because no water is used to lower the temperature and remove toxins and debris from the smoke or product vapor. The user enjoys a cooled, filtered and/or purified smoke from the mouth end 110*a* of the pipe 100.

Depending on the dimensions and/or configurations of the body 102, the heat capacity and/or the thermal conductivity of the material used to form the body 102, by the time the smoke travels through the smoke path 120 and reaches the mouth end 110*a*, the temperature of the smoke can decrease significantly. In some embodiments, the smoke temperature can drop below 100 degrees Fahrenheit. To reach an even lower temperature, the pipe 100 or at least the body 102 may be stored in a cooler or refrigerator when not in use. When a user desires to use the pipe 100, the cooled pipe 100 or body 102 can reduce the smoke temperature to, e.g., below room temperature by the time the smoke reaches the mouth end 110*a*.

The body 102, including the internal channels 126, the external channels 128, and other features of the smoke processing portion 112, can be made by casting, molding, 3D-printing, or any other suitable manufacturing processes. Alternatively, the internal channels 126, the external channels 128, and/or any other features of the smoke processing portion 112 may be formed by machining, such as milling, grinding, cutting, pressing, and so on, an elongated rod. The elongated rod may be formed by casting, molding, extruding, 3D-printing, or any other suitable manufacturing processes.

With further reference to FIGS. 1B and 1C, the cover 104 includes a hollow cylinder or tube. The cover 104 slides onto the smoke processing portion 112 from the mouth end 110*a* of the body 102 and stops at the step 116 formed between the smoke processing portion 112 and the gripping portion 114. The cover 104 has an inner diameter substantially similar to the diameter of the smoke processing portion 112. When the cover 104 is placed around the smoke processing portion 112, the exterior surface 113 of the smoke processing portion 112 contacts the interior surface 130 of the cover 104, and the smoke is contained within the external channels 128. The length of the cover 104 is the same as or similar to the length of the smoke processing portion 112 in this embodiment, but can be longer or shorter than the smoke processing portion 112 in other embodiments.

The interior surface 130 of the cover 104 and an exterior surface 132 of the cover 104 define a thickness of the cover 104. The cover 104 is about 0.03 inches thick in this embodiment, but can be about 0.03 to about 0.125 inches thick in other embodiments. For example, the cover 104 may be at least about 0.02, 0.03, 0.04, 0.05, 0.06, 0.07, 0.075, 0.08, 0.09, 0.1, 0.11, 0.12, 0.125, 0.13, 0.14, or 0.15 inches thick in various embodiments. In this embodiment, both the interior surface 130 and the exterior surface 132 of the cover 104 are cylindrical, and the cover 104 has a uniform thickness. In other embodiments, the cover 104 can have a varied thickness depending on the configuration of the interior surface 130 and the exterior surface 132.

In some embodiments, the exterior surface 132 may include one or multiple flat side surfaces on which the pipe 100 can rest. When the pipe 100 rests on this flat side surface, the bowl 106 is maintained in an upright position. As discussed earlier, the configuration of the internal and external channels 126, 128 and the longitudinal reservoirs 134 adjusts the weight distribution of the pipe 100 and helps to maintain the bowl 106 in an upright position. With this flat side surface, the design of the internal channels 126, the external channels 128 and/or the longitudinal reservoirs 134 can be varied and more flexible. Depending on the shape of the smoke processing portion 112, the shape of the interior surface 130 of the cover 104 also varies so as to conform to the exterior surface 113 of the smoke processing portion 112.

The cover 104 includes one or more apertures or air inlets 138. When the cover 104 is placed around the body 102, the air inlets 138 are positioned over the bowl opening 108. The air inlets 138 allow the smokeable material inside the bowl 106 to be lit by external flame when the cover 104 is placed around the body 102. The air inlets 138 further regulate the air flow into the bowl 106. The size and/or the number of the air inlets 138 are configured to be large enough to allow sufficient air to flow into the bowl 106 to keep the smokeable material burning. The size and/or the number of the air inlets 138 are also configured to be small enough to block out the wind or excessive air to keep the smokeable material burning at a steady rate and to prevent the temperature of the burning smokeable material from reaching too high. The air inlets 138 are also sized to limit or prevent spillage of the smokeable material from the bowl 106.

The air inlets 138 are formed as round apertures in this embodiment, but may be formed as oval, triangular, square, diamond, rectangular, pentagonal, hexagonal, or any other suitably shaped apertures. In some embodiments, the air inlets 138 may be formed as one or more slits arranged in a parallel, cross, or any other suitable fashion. The cover 104 is configured with four air inlets 138 in this embodiment, but may include more or less air inlets 138 in other embodiments. In some embodiments, the cover may include only one air inlet 138 that is shaped and/or sized substantially similar to the bowl opening 108.

To facilitate the alignment between the air inlets 138 with the bowl opening 108 and to secure the cover 104 to the smoke processing portion 112, the body 102 and the cover 104 include an engagement mechanism. Specifically, the body 102 includes a ball detent or ball plunger 150 near the mouth end 110*a* of the body 104. The cover 104 includes at least a first aperture 156*a* that is configured to engage the ball detent 150. The first aperture 156*a* is positioned such that when the ball detent 150 engages the first aperture 156*a*, the air inlets 138 of the cover 104 are placed over or aligned with the bowl opening 108.

The cover 104 further includes a second aperture 156*b* that is also configured to engage the ball detent 150. When the ball detent 150 is engaged with the second aperture 156*b*, the air inlets 138 are out of alignment with the bowl opening 108 and the air flow into the bowl 106 and the smoke path 120 is substantially blocked. The burning of the smokeable material gradually diminishes. The user may continue smoking until the burning of the smokeable material stops. The second aperture 156*b* is positioned opposite to the first aperture 156*a* in this embodiment, but can be positioned at other locations as long as the engagement between the ball detent 150 and the second aperture 156*b* places the air inlets 150 out of alignment with the bowl opening 108.

Figure 1F:
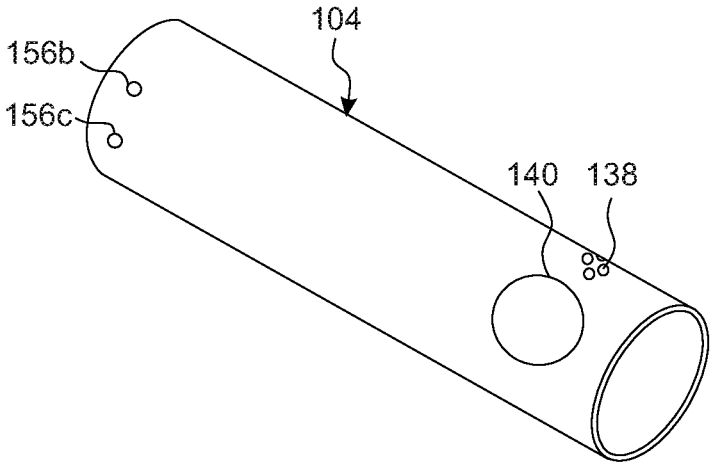
FIG. 1F illustrates a perspective view of another embodiment of a cover of the pipe.

With reference to FIG. 1F, in some embodiments, the cover 104 may include an air hole 140, in addition to the multiple air inlets 138. The air hole 140 and the multiple air inlets 138 are arranged along a circumference of the cover 104. The air hole 140 may be sized substantially similar to the bowl opening 108. The air hole 140 can be placed over or aligned with the bowl opening 108 by rotating the cover 104 relative to the body 102. The cover 104 includes a third aperture 156*c*. When the ball detent 150 is engaged with the third aperture 156*c*, the air hole 140 of the cover 104 are placed over or aligned with the bowl opening 108. Depending on the property of the smokeable material, the user may choose to align either the air hole 140 or the multiple air inlets 138 with the bowl opening 108 when smoking. Further, when the larger air hole 140 is aligned with the bowl opening 108, the bowl 106 can be replenished without taking the cover 104 off the body 102.

In some embodiments, the cover 104 may include a groove formed on the interior surface 130 of the cover 104 connecting the multiple apertures 156. The groove is configured to engage the ball detent 150 to guide the rotation of the cover 104 relative to the body 102. The engagement between the groove and the ball detent 150 further limits the movement of the cover 104 relative to the body 102 along the longitudinal axis of the body 102. The ball detent 150 and the apertures 156 are positioned near the mouth end 110*a* in this embodiment, but can be positioned at any suitable location along the smoke processing portion 112 of the body 102 in other embodiments. Instead of or in addition to the ball detent 150 and apertures 156, other engagement mechanisms, such as magnetic connection, may be utilized.

The cover 104 can be made of metal, alloy, wood, glass, plastic, composite, or any other suitable materials. In some embodiments, the exterior surface 132 of the cover 104 may be formed with surface textures so as to provide additional friction for the user to hold the cover 104 when placing it around or removing it from the body 102. In the case of metal or alloy, the cover 104 can be made of aluminum, copper, iron, silver, brass, bronze, stainless steel, or any other suitable metals or alloys. During normal operation of the pipe 100, the heat of the smoke is not only absorbed by the smoke processing portion 112, but also dissipated through the cover 104.

Figure 2A:
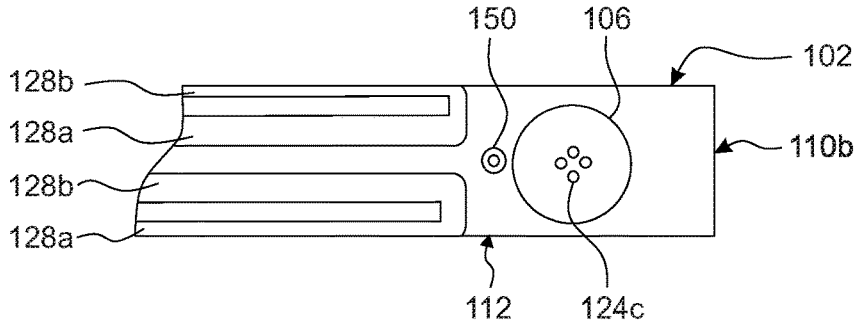
FIG. 2A illustrates a top view of another embodiment of a body of a pipe.
Figure 2B:
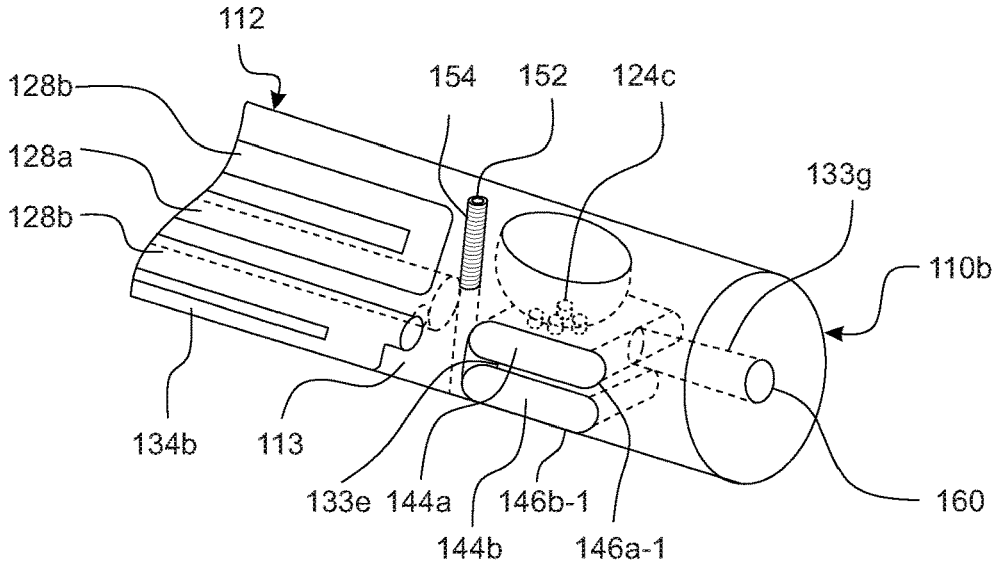
FIGS. 2B and 2C illustrate perspective views of the body of FIG. 2A.
Figure 2C:
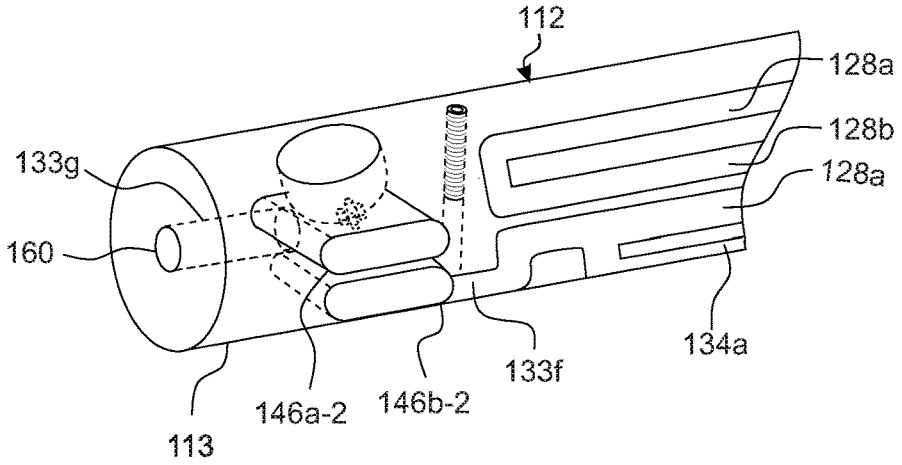

With reference to FIGS. 2A, 2B, and 2C, another embodiment of a pipe for processing smoke and for controlling the flow of the smoke is shown. The cover 104 is removed to better illustrate the details of the body 102. This embodiment differs from the embodiment of FIGS. 1A to 1E in the following ways. First, the gripping portion 114 is formed at the mouth end 110*a* of the body 102 in this embodiment. Accordingly, the cover 104 is placed onto the smoke processing portion 112 from the bowl end 110*b* of the body 102. Second, the ball detent 150 is positioned between the bowl 106 and the external channels 128. As shown in FIGS. 2B and 2C, the ball detent 150 includes a ball plunger 152 that has external threads and fits inside a bore 154 of the body 102 that is with internal threads mating with the external threads of the ball plunger 152. Furthermore, the body 102 includes one or more transverse reservoirs 144 formed below the bowl 106.

With further reference to FIGS. 2B and 2C, the body 102 includes a first transverse reservoir 144*a* formed below the bowl 106. The first transverse reservoir 144*a* is formed as a transverse through hole or horizontal slot in the body 102 that has a first opening 146*a*-1 and a second opening 146*a*-2 formed on the opposite sides of the exterior surface 113 of the smoke processing portion 112. The body 102 further include a second transverse reservoir 144*b* formed below the first transverse reservoir 144*a*. The second transverse reservoir 144*b* is also formed as a transverse through hole or horizontal slot in the body 102 with a first opening 146*b*-1 and a second opening 146*b*-2 formed on the opposite sides of the exterior surface 113 of the smoke processing portion 112.

The first transverse reservoir 144*a* is communicatively coupled or connected with the bowl 106 via one or more conduits or orifices 124*c*. The first transverse reservoir 144*a* and the second transverse reservoir 144*b* are communicatively coupled with each other via a connecting channel 133*e*. The second transverse reservoir 144*b* is communicatively coupled to the exterior channels 128 via another connecting channel 133*f*.

Each of the first and second transverse reservoirs 144*a*, 144*b* has a width dimension extending along or parallel to the longitudinal axis of the body 102 greater than its height dimension. The height dimension of the transverse reservoirs 144*a*, 144*b* is similar to the width dimension of the exterior channels 128 in this embodiment. In other embodiments, the height dimension of the transverse reservoirs 144*a*, 144*b* may be greater or less than the width dimension of the exterior channels 128. For example, the height dimension of the transverse reservoir 144*a*, 144*b* may be at least about 0.25, 0.5, 0.75, 1, 1.5, 2, 2.5, or 3 times the width dimension of the exterior channels 128. The width dimension of each of the first and second transverse reservoirs 144*a*, 144*b* may be at least 1, 2, 3, 4, 5, 6, 7, or 8 times its height dimension in various embodiments. The height dimension of each of the first and second transverse reservoirs 144*a*, 144*b* may be at least 0.1, 0.2, 0.3, 0.4, or 0.5 inches.

In this embodiment, the connecting channel 133*e* is positioned at the ends of the width dimension of the transverse reservoirs 144*a*, 144*b* near the bowl end 110*b*. The connecting channel 133*e* connects the first opening 146*a*-1 of the first transverse reservoir 144*a* with the first opening 146*b*-1 of the second transverse reservoir 144*b*. In other embodiments, the connecting channel 133*e* may be positioned at the opposite ends of the width dimensions, at a position between the ends, or at any other suitable location between the first and second transverse reservoirs 144*a*, 144*b*.

In further embodiments, instead of being connected via the connecting channel 133*e*, the first and second transverse reservoirs 144*a*, 144*b* may be connected via one or more orifices 124 similar to how the bowl 106 and the first transverse reservoir 144*a* is connected. In this embodiment, the connecting channel 133*e* has a depth similar to that of the exterior channels 128. In other embodiments, the connecting channel 133*e* may be shallower, deeper, or even formed as a through hole extending parallel to the first and second transverse reservoirs 144*a*, 144*b*.

During operation, the cover 104 is placed around the smoke processing 112. The openings 146*a*-1, 146*a*-2, 146*b*-1, 146*b*-2 of the transverse reservoirs 144*a*, 144*b* are closed by the cover 104. The smoke travels from the bowl 106 to the first transverse reservoir 144*a* through the one or more orifices 124*c*, then to the second transverse reservoir 144*b* through the connecting channel 133*e*, then to the exterior channels 128 through the connecting channel 133*f*. Because of the greater width dimension of each of the first and second transverse reservoirs 144*a*, 144*b*, even though the smoke only travels a distance equal to or less than the diameter of the body 102 inside each transverse reservoir 144*a*, 144*b*, the smoke is exposed to a larger surface area of each transverse reservoir 144*a*, 144*b*.

As the smoke travels through the first and second transverse reservoirs 144*a*, 144*b*, the smoke is cooled, and much of the moisture, oil, burned tobacco, debris, and/or other undesirable substances are condensed and/or collected on the interior surfaces of the first and second transverse reservoir 144*a*, 144*b*. The smoke path 120 along the exterior channels 128 and the internal channel 126 is kept relatively clean. The longitudinal reservoirs 134*a*, 134*b* and/or the end pockets 135*a*, 135*b* may be omitted. Because the first and second transverse reservoirs 144*a*, 144*b* are formed as through holes or horizontal slots, the debris or any substances collected inside the first and second transverse reservoir 144*a*, 144*b* can be easily accessed and cleaned.

Figure 2D:
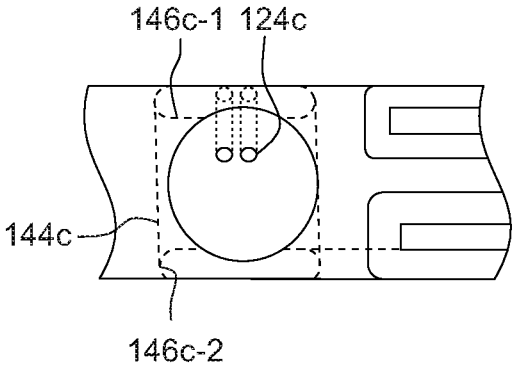
FIG. 2D illustrates a top view of another embodiment of the body of the pipe.
Figure 2E:
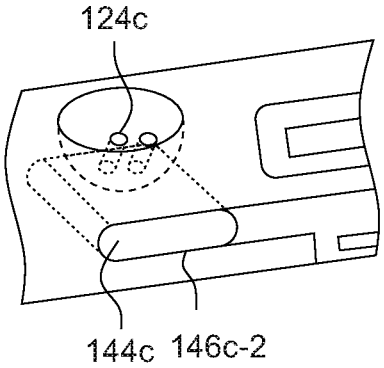
FIG. 2E illustrates a perspective view of the body of FIG. 2D.

Two transverse reservoirs 144*a*, 144*b* are shown in the embodiment of FIGS. 2B and 2C. The body 102 may include only one or more than two transverse reservoirs 144 formed as through holes or horizontal slots in various other embodiments. FIGS. 2D and 2E shows the embodiment that has only one transverse reservoir 144*c* formed as a horizontal slot below the bowl 106. The one or more orifices 124*c* may be positioned towards the side of the bowl 106 and point towards one of the openings 146*c*-1 of the transverse reservoir 144*c*. As such, the smoke enters the transverse reservoir 144*c* near one of the openings 146*c*-1 and is directed to flow towards the other opening 146*c*-2 and is cooled by the transverse reservoir 144*c* before entering into the exterior channels 128.

Figure 2F:
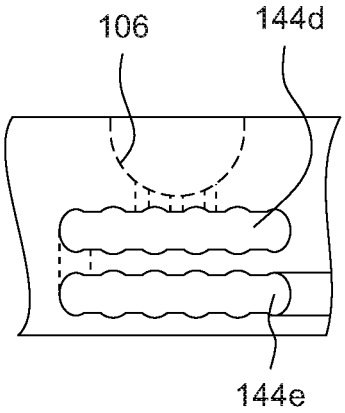
FIGS. 2F and 2G illustrate front views of embodiments of transverse reservoirs of the body of the pipe.

FIG. 2F illustrates another embodiment of the transverse reservoirs 144*d*, 144*e*. Different from the embodiment of FIGS. 2B and 2C in which the first and second transverse reservoirs 144*d*, 144*e* are formed with relatively smooth interior surfaces, the transverse reservoirs 144*d*, 144*e* in the embodiment of FIG. 2F are formed with undulating interior surfaces to increase the surface area for heat absorption from the smoke. In other embodiments, the interior surfaces of the transverse reservoirs 144*d*, 144*e* may be formed with ridges, grooves, depressions, and/or indentations to further increase surface area for heat absorption.

Figure 2G:
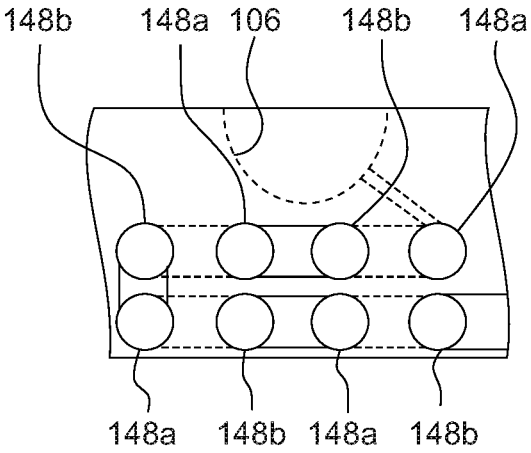

FIG. 2G illustrates another embodiment of the transverse reservoirs. In this embodiment, the transverse reservoirs are formed as two rows of transverse holes 148. Each row includes one or more first transverse holes 148*a* and one or more second transverse 148*b*. The first and second transverse holes 148*a*, 148*b* are arranged in an alternating manner and direct the smoke to travel in opposite directions. Accordingly, the first and second transverse holes 148*a*, 148*b* guide the smoke to travel in a circuitous manner similar to how the external channels 128*a*, 128*b* guide the smoke, except that the smoke travels along the transverse holes 148*a*, 148*b* in a direction perpendicular to the longitudinal axis of the body 102.

Two rows of the transverse holes 148 are shown in this embodiment, and each row has four transverse holes 148. In other embodiments, the body 102 may include only one row or more than two rows of the transverse holes 148, and each row may include more or less than four transverse holes 148. In this embodiment, the cross section of the transverse holes 148 are circular. In other embodiments, the transverse holes 148 may have oval, triangular, square, rectangular, diamond, pentagonal, hexagonal, or any other suitably shaped cross section.

Referring back to FIGS. 2B and 2C, the body 102 further includes a carburetor 160. The carburetor 160 is formed as an opening at the bowl end 110*b* of the body 102 in this embodiment, but can be formed at any suitable location, such as at the exterior surface 113 of the smoke processing portion 112. The carburetor 160 is communicatively coupled with the first transverse reservoir 144*a* via a connecting channel 133*g*. As such, air can be drawn from the carburetor 160 into the smoke path 120, and the smoke or vapor product can be drawn toward the mouth end 110*a* with limited or no burning of the smoking material in the bowl 106.

Figure 2H:
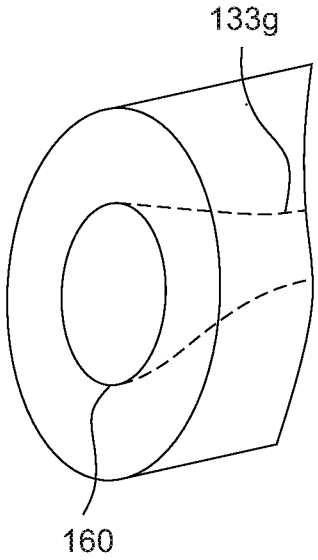
FIGS. 2H and 2I illustrate perspective views of embodiments of a carburetor of the body of the pipe.
Figure 2I:
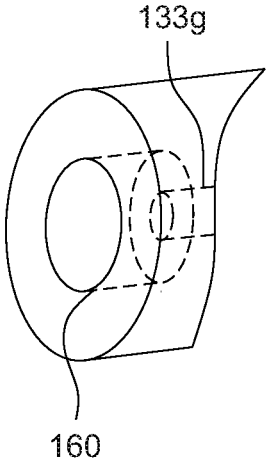

In some embodiments, the connecting channel 133*g* may include a tapered or stepped profile along its length as shown in FIGS. 2H and 2I. The connecting channel 133*g* is configured with a greater cross dimension near the bowl end 110*b* to receive a cigarette, a cigar, or a connecting piece for connecting a cigarette, a cigar, or other similar products to the connecting channel 133*g*. This way, the user may use the pipe 100 to smoke the cigarette or cigar but achieve a much cooler smoke temperature as compared to smoke the cigarette or cigar directly. Further, as the smoke of the cigarette or cigar travels through the smoke path 120, the impurities or any undesirable substances are removed therefrom. When the user smokes the cigarette or cigar that is connected to the connecting channel 133*g*, the bowl 106 may function as a carburetor. Alternatively, the user may smoke the cigarette or cigar that is connected to the connecting channel 133*g* in combination with the material in the bowl 106 to obtain a mixed flavor.

The various embodiments of the smoking pipes described herein control the flow the smoke. As the smoke travels through the various configurations of the smoke path, the smoke is cooled, and moistures, debris, oil, burned smokeable materials, and/or any other undesirable substances are collected inside the various reservoirs and/or along the smoke path. Depending on the configuration of the smoke path and the heat capacity and/or heat conductivity of the materials used for the body and/or the cover, by the time the smoke reaches the mouth end of the pipe, the temperature of the smoke can decrease significantly. In some embodiments, the smoke temperature can drop below 100 degrees Fahrenheit or even below room temperature.

As compared to a smoking pipe that allows the smoke to travel directly from the smoking bowl to the mouth end which results the smoke to reach the user at a burning or very hot temperature, the various embodiments of the pipes described herein cools the smoke to a much lower or even soothing temperature and provides the user with much improved and pleasant smoking experience. In addition, much of the debris, burned smokeable materials, oil, and/or other undesirable substances are filtered and removed from the smoke. Using the pipes described herein instead of pipes that allows hot smoke to travel directly to the user can help improve the user's respiratory function.

In addition to the various functionalities described above, the embodiments also offer a durable, light-weight, compact, and sleek design, which is not only aesthetically pleasing but also can be carried around easily. The embodiments described herein further provide the user with the ease of caring for and maintaining the pipes because the cover is removable and the smoke path is formed by channels formed as open grooves and/or through holes.

Specific details are given in the above description to provide a thorough understanding of the embodiments. However, it is understood that the embodiments may be practiced without these specific details.

While the principles of the disclosure have been described above in connection with specific apparatuses and methods, it is to be clearly understood that this description is made only by way of example and not as limitation on the scope of the disclosure.

What is claimed is:

1. A pipe for cooled smoke and containment, comprising:

a body, comprising:

a first portion disposed along a longitudinal axis of the body; and a second portion disposed along the longitudinal axis of the body, the first portion and the second portion collectively define a length of the body extending between opposite ends of the body;

a recess defined at an exterior surface of the second portion and recessed from the exterior surface of the second portion towards the longitudinal axis of the body, the recess configured to receive a smoking material; and a sleeve configured to be removably placed around the second portion of the body, wherein:

the sleeve includes an outer profile that substantially corresponds to an outer profile of the first portion of the body;

when the sleeve is placed around the second portion of the body, the first portion of the body and the sleeve collectively define an outer profile of the pipe that is continuous along the first portion and the sleeve; and the second portion of the body comprises a plurality of grooves closed by the sleeve to form a smoke path to guide smoke to travel back and forth between the opposite ends of the body.

2. The pipe of claim 1, wherein the sleeve is cylindrical, and the outer profile of the pipe is cylindrical along the first portion and the sleeve.

3. The pipe of claim 1, wherein the sleeve further comprises a first open end and a second open end, wherein:

the second portion of the body is configured to be slidable into the sleeve from the first open end of the sleeve; and when the sleeve is placed around the second portion of the body, at least a portion of the second portion of the body extends from the first open end to the second open end of the sleeve.

4. The pipe of claim 1, wherein:

the sleeve further comprises an aperture sized to correspond to an opening of the recess of the second portion of the body;

the sleeve is configured to be rotatable about the longitudinal axis of the body between a first position and a second position;

when the sleeve is rotated to the first position, the aperture of the sleeve is aligned with the opening of the recess; and when the sleeve is rotated to the second position, the opening of the recess is closed by a portion of the sleeve.

5. The pipe of claim 1, wherein:

the plurality of grooves defined at the exterior surface of the second portion; and at least some of the plurality of grooves are disposed above the longitudinal axis of the body such that a center of gravity of the body is below the longitudinal axis of the body to maintain the recess in an upright orientation when the pipe rests on a surface.

6. The pipe of claim 5, wherein the sleeve further includes an inner profile that substantially corresponds to an outer profile of the second portion of the body such that when the sleeve is placed around the second portion of the body an interior surface of the sleeve engages the exterior surface of the second portion of the body.

7. The pipe of claim 1, wherein a depth of at least some of the plurality of the grooves ranges from 0.15 to 0.25 inches such that moisture, oil, or debris is collected in the plurality of grooves as smoke travels along the plurality of the grooves.

8. The pipe of claim 1, wherein the first portion of the body and the second portion of the body are formed as a unitary body.

9. The pipe of claim 1, wherein a length of the sleeve is the same as a length of the second portion of the body.

10. The pipe of claim 1, wherein the second portion of the body includes an outer diameter that is consistent along a length of the second portion of the body.

11. The pipe of claim 1, wherein a length of the first portion of the body is less than a length of the second portion of the body.

12. The pipe of claim 1, wherein a length of the second portion of the body ranges from 2 inches to 9 inches.

13. A pipe for cooled smoke and containment, comprising:

a body, comprising:

a first portion disposed along an axis of the body extending between a first end and a second end of the body, wherein:

the first portion has a first diameter; and the first portion defines one of the first end or the second end;

a second portion disposed along the axis of the body, wherein:

the second portion has a second diameter;

the second diameter is less than the first diameter;

the second portion defines the other one of the first end or the second end; and the first portion and the second portion collectively define a length of the body;

a recess defined at an exterior surface of the second portion and configured to receive a smoking material; and a sleeve configured to be placed around the second portion of the body, wherein:

an outer diameter of the sleeve substantially corresponds to the first diameter of the first portion of the body;

when the sleeve is placed around the second portion of the body, the first portion of the body and the sleeve define an exterior surface of the pipe that is continuous and cylindrical; and the sleeve comprises an inner diameter that corresponds to the second diameter of the second portion of the body such that when the sleeve is placed around the second portion of the body;

an interior surface of the sleeve engages the exterior surface of the second portion of the body; and the plurality of grooves is closed by the sleeve to guide smoke to travel back and forth between the first end and the second end of the body.

14. The pipe of claim 13, wherein the sleeve is further configured to rotate about the axis of the body when the sleeve is placed around the second portion of the body to open or close an opening of the recess.

15. The pipe of claim 13, wherein:

the second portion further comprises a plurality of grooves defined at an exterior surface of the second portion; and at least some of the plurality of grooves are disposed above the axis of the body such that a center of gravity of the body is below the axis of the body to maintain the recess in an upright orientation when the pipe rests on a surface.

16. A pipe for cooled smoke and containment, comprising:

an elongate body comprising a plurality of grooves;

a recess defined at an exterior surface of the elongate body and configured to receive a smoking material; and a sleeve that is tubular and configured to be removably placed around the elongate body, wherein:

when the sleeve is placed around the elongate body, at least a portion of the elongate body extends outside the sleeve;

the portion extending outside the sleeve includes an outer profile that corresponds to an outer profile of the sleeve such that the sleeve and the portion extending outside the sleeve form an exterior surface of the pipe that is tubular along the sleeve and the portion extending outside the sleeve;

at least some of the plurality of grooves are disposed above a longitudinal axis of the elongate body such that a center of gravity of the elongate body is below the longitudinal axis of the elongate body to maintain the recess in an upright orientation when the pipe rests on a surface;

the plurality of grooves defined at an exterior surface of the elongate body; and an interior surface of the sleeve is configured to engage an exterior surface of the elongate body such that when the sleeve is placed around the elongate body, the plurality of grooves is closed by the sleeve to form a smoke path to guide smoke to travel back and forth between opposite ends of the elongate body.

17. The pipe of claim 16, wherein:

the sleeve comprises a first open end and a second open end;

the elongate body is slidable into the sleeve from the first open end of the sleeve; and at least a portion of the elongate body is received inside the sleeve and extends from the first open end to the second open end of the sleeve when the sleeve is placed around the elongate body.

* * * * *